US005771709A

United States Patent [19]

Smith

[11] Patent Number: 5,771,709

[45] Date of Patent: Jun. 30, 1998

[54] ELECTRIC COUNTER MOUNTED BEVERAGE COOLER AND DISPENSER

[76] Inventor: Curley P. Smith, 103 N. Montford Ave., Baltimore, Md. 21224

[21] Appl. No.: 708,299

[22] Filed: Sep. 4, 1996

[51] Int. Cl.[6] ..... B67D 5/62

[52] U.S. Cl. ..... 62/389; 62/392; 62/394; 222/146.6; 222/160; 222/155; 222/180

[58] Field of Search ..... 62/389, 392, 394, 62/395, 397, 390, 391; 222/146.1, 146.2, 146.6, 129.1, 160, 154, 155, 158, 180, 181.3

[56] References Cited

U.S. PATENT DOCUMENTS 1,895,085 1/1933 Peltier ..... 62/394
2,251,736 8/1941 Hill ..... 62/392
2,785,545 3/1957 Pusey ..... 62/392
2,928,257 3/1960 Rovner et al. ..... 62/389
3,341,077 9/1967 Gordon ..... 62/392

*Primary Examiner*—John M. Sollecito

[57] ABSTRACT

The present invention is directed to a beverage cooler and dispenser which is compact enough to fit on a counter top yet large enough to hold a substantial volume of liquid. The beverage cooler includes a refrigeration unit having a compressor with a condenser located inside of the reservoir tank and an evaporator external to the unit, a pump for circulating the liquid, a dispenser, and a liquid level gauge. The device has an electrical cord for connection to a direct current outlet.

7 Claims, 2 Drawing Sheets

ELECTRIC COUNTER MOUNTED BEVERAGE COOLER AND DISPENSER

BACKGROUND OF THE INVENTION

The present invention relates to the field of beverage coolers and dispensers. More particularly, this invention relates to beverage coolers and dispensers which are compact and portable.

Typically, to have ice-cold water or other cool beverages available at all times in your kitchen, people must have either a water cooler or water kept in the refrigerator. The water coolers which are commercially available today that accommodate 5-gallon bottles are large and take up valuable floor space in the kitchen. For many homes and apartments there is no extra floor space for such a cooler. Moreover, these coolers are not for sale and the monthly rental charges quickly add up.

The alternative to a large water cooler is to maintain a supply of water in a container in the refrigerator. However, unless the container is of a substantial size, a person will have to continually refill the container in order to always have cold water available. Water is commercially available in bulky 2 and ½ gallon containers, but these containers use up a large amount of refrigerator space.

Therefore, there is a need for a device which can store water or other beverages and dispense them at a cold temperature which does require large amounts of floor or refrigerator space.

Several devices have been designed to fill this need. For example, U.S. Pat. No. 4,913,318, issued to Forrester, teaches a portable beverage heater, cooler and dispenser. A device for cooling or heating a liquid incorporating a fan for heat exchange is shown in U.S. Pat. No. 4,274,262, issued to Reed et al. U.S. Pat. No. 4,880,535, issued to Burrows, discloses a system for storing beverages at a particular temperature. While, U.S. Pat. Nos. 4,866,945, 5,469,708 and 4,757,920, issued to Bender et al., Harrison et al. and Harootian, Jr. et al. respectively, show coolers for the commercially available 2 and ½ gallon water bottles.

However, none of these devices includes refrigeration system which includes a condenser and an evaporator, with an evaporator positioned in a water reservoir, and a pump for circulating the water. Additionally, none of these devices has way to determine the level of remaining liquid without opening the unit nor a means for mounting the device under a counter. Therefore there is a need for an improved compact beverage cooler and dispenser.

SUMMARY OF THE INVENTION

The present invention is directed to a beverage cooler and dispenser which is compact enough to fit on a counter top yet large enough to hold a substantial volume of liquid. The beverage cooler includes a refrigeration unit having a compressor with an evaporator located inside of the reservoir tank and a condenser external to the unit, a pump for circulating the liquid, a dispenser, and a liquid level gauge. There is also an on/off switch and a temperature control. The device has an electrical cord for connection to a direct current outlet.

A dispensing area is located at the front of the device. There is a fill tube and a release lever. In order to dispense water from the device, a glass or other receptacle is placed under the fill tube and against the release lever. The release lever is depressed and water comes out of the fill tube.

OBJECTS OF TEE INVENTION

Therefore, it is an object of this invention to provide a beverage and water cooler system which is self-contained and can be positioned on a countertop.

It is a further object of this invention to provide a beverage and water cooler system with a refrigeration unit having a compressor, condenser and an evaporator.

It is another object of this invention to provide a beverage and water cooler system with a liquid level gauge for visually checking the level of liquid in the container.

It is still another object of the present invention to provide a beverage and water cooler system which both cools and dispenses a supply of water from a reservoir.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE DRAWINGS

Figure 1:
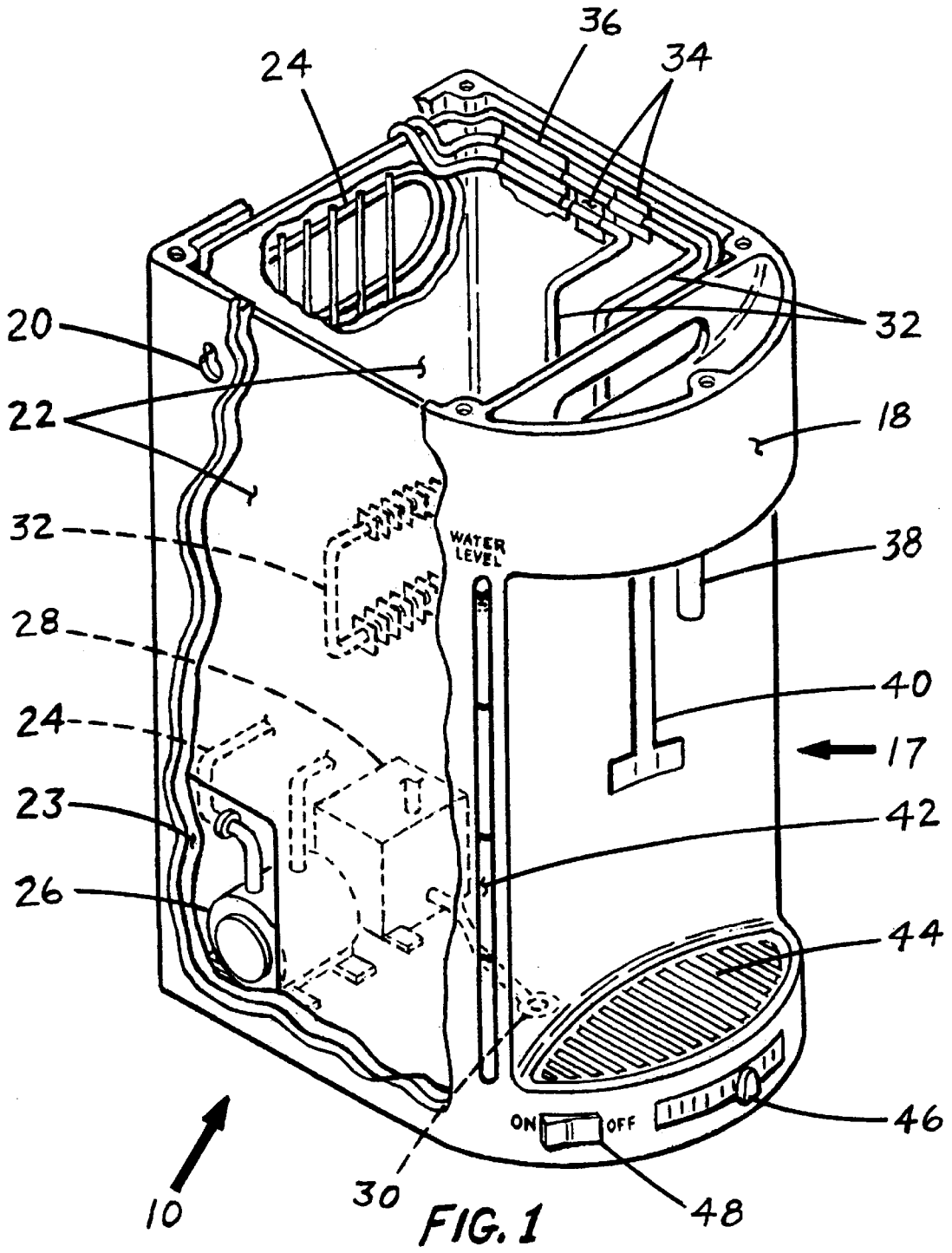
FIG. 1 shows a perspective view of a version of the present invention in partial cutaway.
Figure 2:
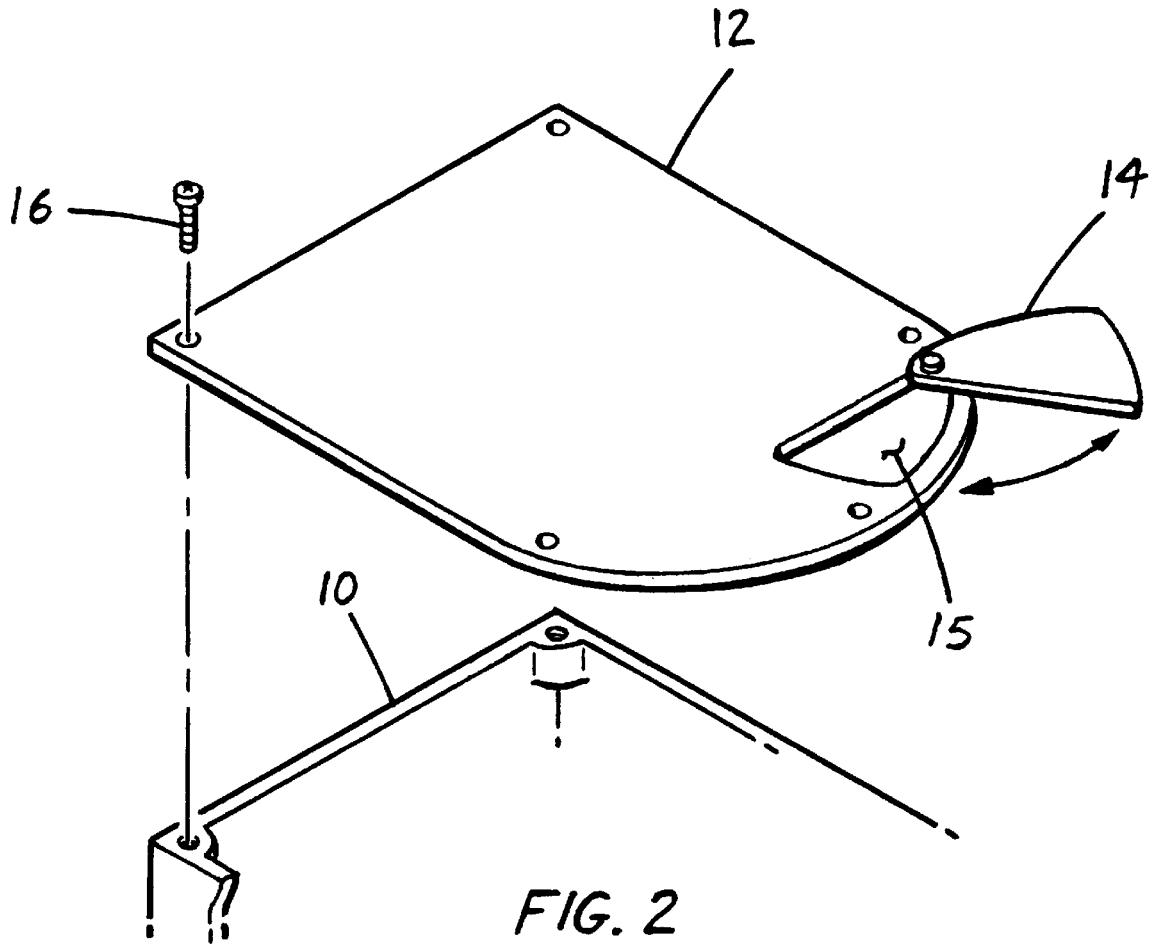
FIG. 2 shows the top of the device of FIG. 1.

Referring now to FIGS. 1 and 2, the present invention is illustrated. The countertop beverage system 10 has a main housing canister 18. This housing canister 18 is insulated 23 to maintain the temperature of a contained liquid and to prevent excess energy from-being used to constantly cool the contents. Inside the housing canister 18 is the water reservoir 22. The water reservoir 22 should be large enough to hold a substantial volume of water yet small enough for the device to fit on a kitchen counter. The water reservoir 22 extends to the top of the device and has a rubber seal position around its top edge to prevent leakage and contamination of the contents.

The water in the water reservoir 22 is cooled by a refrigeration unit which, has a compressor 26 external to the water reservoir 22, an evaporator 32 which is positioned inside the water reservoir 22, and a condenser 24 which mounted to the outside rear of the housing canister 18. The evaporator 32 are supported by stabilizers 34 which attach to the interior of the housing canister 18 and the water reservoir 22. Power is supplied to the refrigeration system from either an AC or DC source for portable or home use.

Water is circulated to prevent growth of bacteria, fungus, mold or other undesirable contaminants by a pump 28. The pump 28 is connected to the same source of power as the refrigeration system.

At the front of the housing canister is the dispenser area 17. This dispenser area has water, release lever 40 which when depressed dispenses water through a fill tube 38. There is a catch tray 44 which is a slotted tray over a small overflow reservoir (not shown). A temperature gauge 46 is positioned at the front of the housing canister 18 and controls the temperature of the refrigeration system. An on/off switch 48 is positioned on the front of the housing canister 22. A water level, gauge 42 is positioned on the side of the housing canister which shows the level of water in the water reservoir 22.

When the water level drops to a certain point the water reservoir 22 can be refilled through the opening 15 in the lid 12 of the housing canister 18 as shown in FIG. 2. There is a horizontal swivel closure 14 which covers the opening 15 located in the front end of the lid when the device is not being refilled. The closure lies flat in the same plane of the lid and is opened and closed by swiveling sideways in the same plane, that is, remaining flat against the lid. The lid 12 is secured to the housing canister 18 by a plurality of screw 16.

A drain port 30 is provided in the bottom of the device for draining the system for cleaning or the like.

The housing canister 18 of the device 10 is a one piece design for easy manufacture. The component parts such as the condenser, compressor, evaporator and pump can be preassemble for insertion into the housing canister 18 at one time. While it is envisioned that the device will be used with spring water, other beverages could be employed with the device as well. Similarly, the device could be used for heating and dispensing heated liquids as well by replacing the refrigeration system with a heating element.

Additionally, the housing canister 22 could be designed for under the counter installation with installation holes 20 on the upper rear sides of the housing or have a counter top stand. Although the present invention has been described in considerable detail with regard to certain preferred versions, other versions are possible. Therefore, the spirit and scope of the appended claims should not be limited to the preferred versions herein contained.

What is claimed is:

1. A cooling and dispensing system for beverages, comprising:

a housing means having opposing front and rear ends, and opposing upper and lower ends and two side walls disposed between the said opposing front and rear ends, and opposing upper and lower ends front, rear, upper and lower ends, a reservoir means positioned inside of said housing means for receiving and holding a liquid supply;

insulation means positioned between said housing means and said reservoir means for insulating said liquid supply;

refrigeration means for cooling said liquid supply and having an evaporator means mounted inside of said reservoir means;

pump means for circulating said liquid supply;

dispensing means for dispensing said liquid supply; and liquid supply level gauge a temperature control gauge;

a drain port in said reservoir means and through said housing means for draining said system; under the counter installation holes provided in the side walls proximate to the upper and rear end, thereby enabling installation under a counter; and a lid disposed in a horizontal plane over the upper end of the housing and an opening formed in said lid proximate the front end of the housing, with a swivel closure disposed on said lid over said opening, pivotable from side to side in the horizontal plane of the lid, thereby providing access to said reservoir to enable filing it with liquid.

2. A cooling and dispensing system for beverages as recited in claim 2, wherein said housing means is formed of rigid molded plastic material.

3. A cooling and dispensing system for beverages as recited in claim 1 further comprising a power source connected to said pump means and said refrigeration means.

4. A cooling and dispensing system for beverages as recited in claim 1 wherein said liquid supply level gauge is integral to said housing means.

5. A cooling and dispensing system for beverages as recited in claim 1, further comprising a temperature control means.

6. A cooling and dispensing system for beverages as recited in claim 1 wherein said dispensing means comprises:

a liquid release lever; and a fill tube, wherein when said water release level is activated liquid is dispensed through said fill tube.

7. A cooling and dispensing system for beverages as recited in claim 1 wherein said refrigeration means further includes compressor means positioned inside of said housing means and external to said reservoir means and condenser means positioned on the rear exterior of said housing means.

* * * * *